US006966255B1

(12) United States Patent
Crittenden

(10) Patent No.: US 6,966,255 B1
(45) Date of Patent: Nov. 22, 2005

(54) LOCK-OUT FOR POWER ASSISTED STRAPPING TOOL

(75) Inventor: David E. Crittenden, Schaumburg, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 0 days.

(21) Appl. No.: 10/912,935

(22) Filed: Aug. 6, 2004

(51) Int. Cl.[7] ..... B65B 13/18; B21F 9/02

(52) U.S. Cl. ..... 100/29; 53/582; 156/443; 156/580; 140/93.2

(58) Field of Search ..... 100/29, 30, 32, 100/33 R, 33 PB; 53/582; 140/93.2, 93.4, 140/150, 152; 156/443, 445, 580

(56) References Cited

U.S. PATENT DOCUMENTS 5,518,043 A * 5/1996 Cheung et al. ..... 140/93.2
6,338,375 B1 * 1/2002 Harada ..... 156/391
6,732,638 B1 * 5/2004 Rometty et al. ..... 100/33 R
6,907,717 B2 * 6/2005 Nix ..... 53/582

* cited by examiner

*Primary Examiner*—Derris H. Banks
*Assistant Examiner*—Jimmy T. Nguyen
(74) *Attorney, Agent, or Firm*—Mark W. Croll, Esq.; Donald J. Breh, Esq.; Welsh & Katz, Ltd.

(57) ABSTRACT

A lock-out assembly for a strapping tool prevents inadvertent actuation of the tool sealer cycle prior to completion of the tensioning cycle. The tool includes a pneumatic module having tensioning cycle and sealer cycle valves mounted therein. The valves are actuated by overlying levers. The lock-out assembly includes an arm operably mounted to the pneumatic module having a first engaging portion for engaging the tensioning valve lever and a second blocking portion for blocking the sealer valve lever. The arm is movable between a first position in which the tensioning valve lever is in the non-actuated position and the arm block portion interferes with movement of the sealer valve lever to prevent moving the sealer valve to the actuated position, and a second position in which the tensioning valve lever engages the arm engaging portion to move the arm blocking portion from interfering with the sealer valve lever to permit moving the sealer valve lever into contact with the sealer valve to move the sealer valve to the actuated position.

20 Claims, 3 Drawing Sheets

LOCK-OUT FOR POWER ASSISTED STRAPPING TOOL

BACKGROUND OF THE INVENTION

The present invention relates to a lock-out for a power assisted strapping tool. More particularly, the present invention relates to a lock-out for a pneumatically (or other assisted) strapping tool that prevents inadvertent out of sequence operation of the tool.

Strapping tools are well-known in the art. A wide variety of tools are known, from fully manually operated tools to automatic, table-top tools. The tools are typically designed for use with either metal strapping or plastic/polymeric type strapping.

Strappers for applying metal strapping materials are often hand-held devices. These can be fully manual, as when an operator applies a force to tension the strap and applies a force to seal the strap (either by a seal-less type of arrangement or by applying a crimp seal). Other strappers are electric or pneumatically actuated to assist in applying the force needed to tension and seal the strap.

In one pneumatic tool, tension and sealing subsystems function to separately and independently tension the strap and form a seal in the strap. The tensioning function is accomplished by actuation/rotation of a tensioning wheel that is pneumatically driven by a pneumatic motor. The strap is tensioned after a free end of the strap is secured (held) by a gripper in the strapper.

After the strap is tensioned, a sealer, also pneumatically actuated and driven, forms a seal in the strap by cutting portions of the overlapped strap layers to form interlocking members.

The tensioning function and sealing function are initiated by levers or switches on the body of the strapper. Ergonomically, in order to facilitate operation of the strapper, the switches are side-by-side. In this manner the operator can hold (support) the strapper with one hand while initiating the tensioning cycle with the other hand, and upon completion of the tensioning cycle, the operator can continue supporting the strapper and initiate the sealing cycle using the same hand that was used to initiate the tensioning cycle. Essentially, one hand is used to support the strapper and the other to operate it. In such a design, the switches for operating the strapper are next to each other so that the operator can easily support and operate the strapper from the beginning of the strapping cycle to the end of the cycle.

It has, however, been found that actuation of the sealing cycle during the tensioning cycle results in misfeeds, bad seals, and other unacceptable conditions. One such condition, referred to as ribboning, occurs when a seal is formed or partially formed in the strap prior to or while tensioning is occurring. In such a condition, the strap "ribbons" up to the sealed strap, within the looped portion of the strap.

Actuation of the sealing cycle during the tensioning cycle is generally inadvertent and is a result of bumping the sealer lever due to the close proximity of the tensioning and sealer switches, or due to improper operation. However, as set forth above, close proximity of the switches facilitates operation of the strapper. In addition, in that the pneumatic systems that are actuated by the switches share portions of the tool's pneumatic circuit, proximity of the switches permits a more compact and efficient tool design.

In an effort to prevent inadvertent actuation of the switches (in other words, inadvertently depressing the switches), while maintaining close proximity of the switches to one another, physical barriers have been positioned between the switches. Even with such barriers, it has been found that inadvertent switch actuation occurs. Moreover, it is thought to be undesirable to place a physically large barrier or separator between the switches.

Other modifications were made to the tool to prevent inadvertent actuation of the sealer cycle during tensioning, including changes to the pneumatic circuit (a delay in the sealer circuit) and increasing the force needed to depress the sealer switch. While these changes in fact did reduce the occurrence of inadvertent actuation, it nevertheless continues to occur.

Accordingly, there is a need for an interlock or lock-out for use in such a pneumatic strapper. Desirably, such a lock-out prevents inadvertent switch depression, without requiring any additional steps in operating the a strapper. More desirably, such a lock-out system adds little to no weight or large structural members to the strapper. Most desirably, such a lock-out is of the type that can be readily adapted to or retrofitted to strappers presently in use.

SUMMARY OF THE INVENTION

A lock-out assembly for a strapping tool prevents inadvertent actuation of the tool sealer cycle prior to completion of the tensioning cycle. The tool is configured to tension a strap around a load and seal the strap onto itself.

The tool has a body, a tensioning wheel and a drive for the tensioning wheel, a sealer and a drive for the sealer and a pneumatic module including a tensioning valve and a sealer valve disposed adjacent one another. Each of the valves is reciprocal between an actuated position and a non-actuated position and each is operably associated with a lever for reciprocating the respective valve between the actuated and non-actuated positions.

Each of the levers is pivotable about a pivot for contacting and reciprocating their respective valves. The levers thus overlie the valves. The levers are pivotable independent of one another.

The lock-out includes an arm operably mounted to the pneumatic module. In a present arrangement, the arm is pivotably mounted to a mounting block that is mounted to the housing or body of the module. The arm has a first, preferably ramped engaging portion for engaging the tensioning valve lever and a second blocking portion for blocking the sealer valve lever.

The arm is movable between a first position in which the tensioning valve lever is in the non-actuated position and the arm block portion interferes with movement of the sealer valve lever to prevent moving the sealer valve to the actuated position, and a second position in which the tensioning valve lever engages the arm engaging portion to move the arm blocking portion from interfering with the sealer valve lever to permit moving the sealer valve lever into contact with the sealer valve to move the sealer valve to the actuated position.

Preferably, the arm is biasedly mounted, as by a spring, to the module to bias the arm to the first position. The lock-out arm ramped portion engages the tensioning valve lever, such that depressing the tensioning valve lever moves the tensioning valve lever onto the ramp, urging the arm against the bias and moving the arm away from the sealer valve lever. This permits the sealer valve lever to be moved into contact with and to move the sealer valve.

To lock the tensioning valve in the actuated position, a detent is formed on the engaging portion that cooperates with a lip on the tensioning valve lever. Depressing the tensioning arm lever to the actuated position engages the detent with the lip to lock the lever (and the valve) in the actuated position. Depressing the sealer valve lever further urges the arm down, unlocking the detent and lip from one another.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
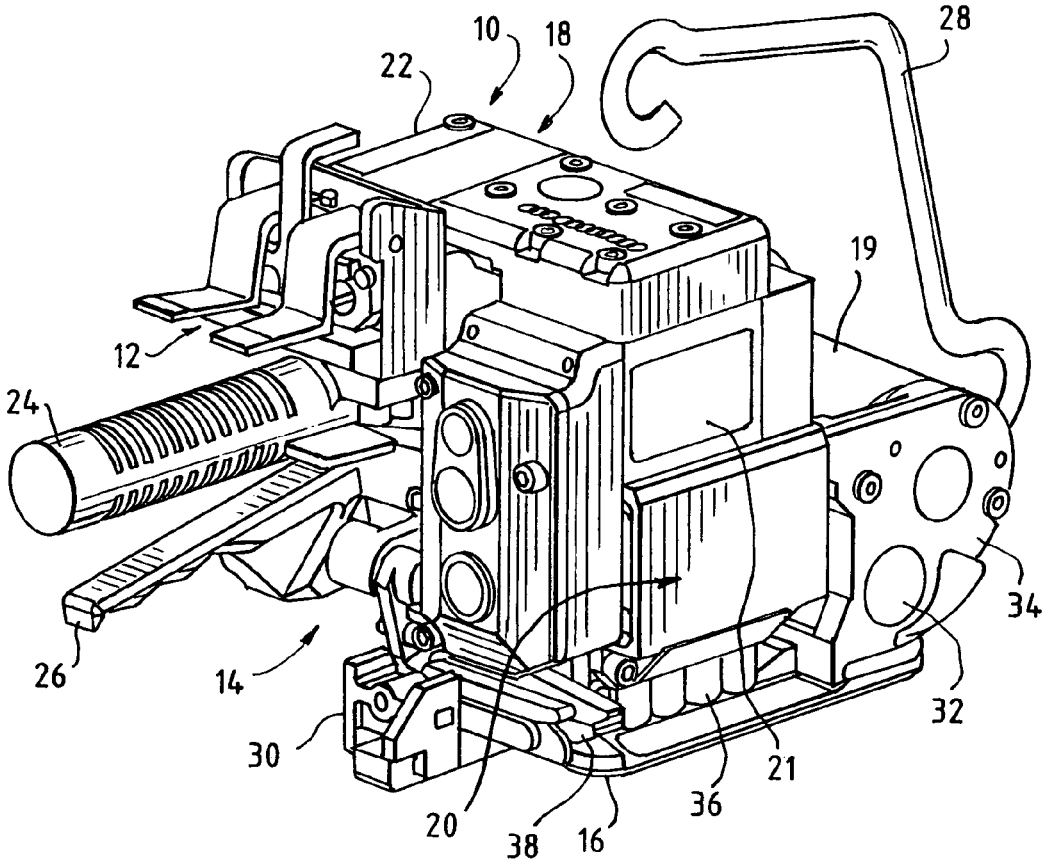
FIG. 1 is a perspective view of a strapping tool (strapper) having a sealing switch lock-out assembly embodying the principles of the present invention.
Figure 2:
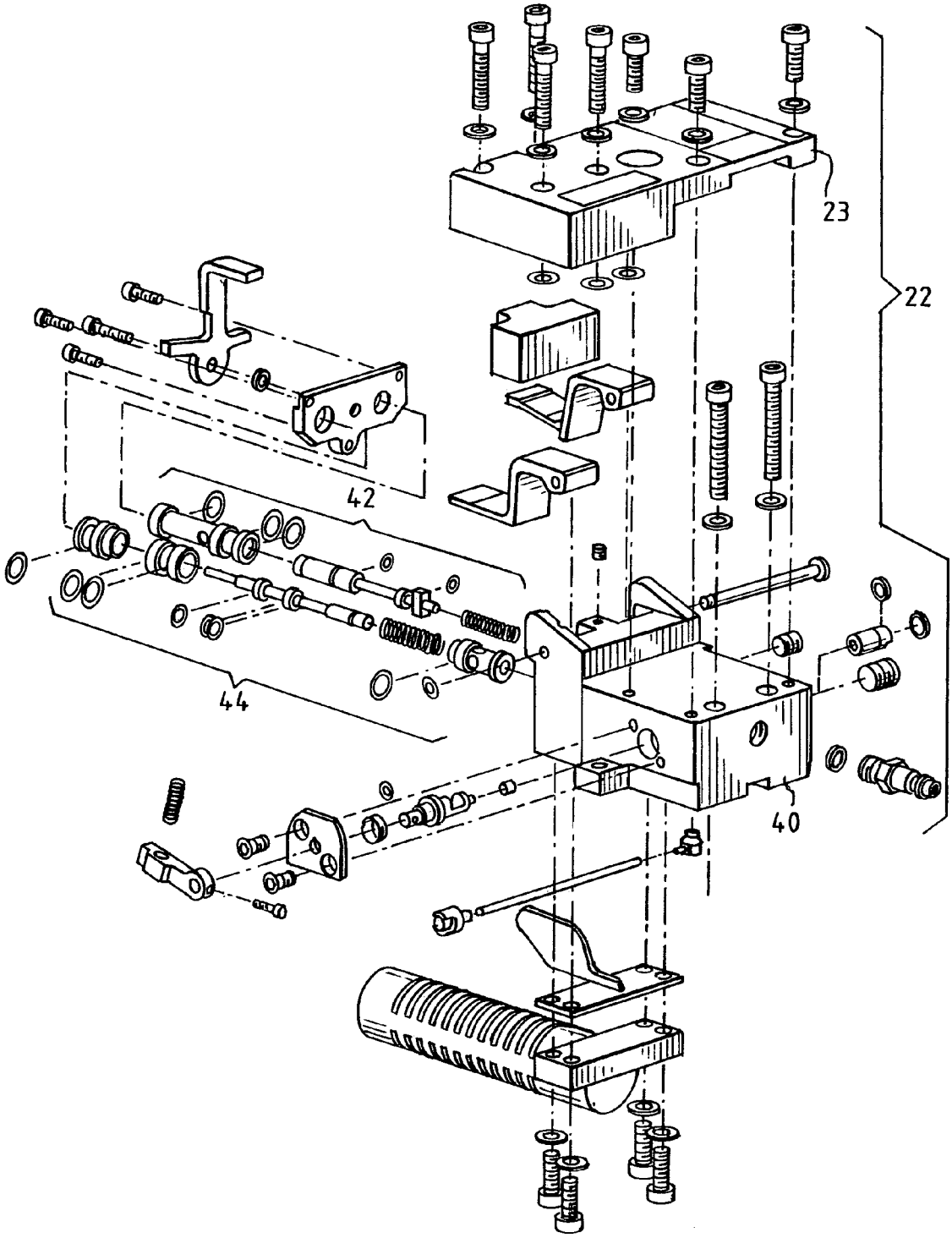
FIG. 2 is an exploded view of the valve assembly portion of the tool of FIG. 1, the valve assembly shown without the lock-out assembly for clarity of illustration.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be understood that the title of this section of this specification, namely, "Detailed Description Of The Invention", relates to a requirement of the United States Patent Office, and does not imply, nor should be inferred to limit the subject matter disclosed herein.

Referring now to the figures and in particular to FIG. 1, there is shown an exemplary strapping tool (strapper) 10 having a lock-out 12 embodying the principles of the present invention. The tool 10 includes, generally, a body 14, a foot 16, a tensioning motor 18, a sealer assembly 20 (including a sealer motor in a sealer motor assembly 21), and a pneumatic module 22. The tool 10 includes a handle 24 and lift handle 26, and a hanger 28, such as those shown, for ease of handling and use. An exemplary strapping tool is commercially available from ITW-SIGNODE® of Glenview, Ill. as pneumatic combination strapping tool SPC-114 or SPC-100.

The tool 10 further includes a strap guide 30 (to introduce the strap S to the sealer assembly 20), and a tensioning wheel 32 disposed within a wheel housing 19 and covered by outer link 34. The illustrated tool 10 is configured for metal strap S and as such, includes a plurality of dies 36 to cut the strap S layers U, L into one another to create an interlocking seal arrangement. A gripper 38 "holds" the bottom strap layer L during tensioning.

The pneumatic module 22 is mounted to the body 14, above the lift handle 26 and, in part, adjacent to the sealer motor assembly 21. A connector plate 23 extends between the pneumatic module 22 and the sealer motor assembly 21. The module 22 provides pneumatic pathways between the module 22, the tensioning motor 18 and the sealer motor assembly 21 for introducing and venting a compressed gas, such as compressed air, to and from the motors.

The module 22 includes a valve housing 40, a tensioning valve 42 and a sealer valve 44. The housing 40 includes bores 46, 48 therein that define the valve chambers or cylinders. Each of the valves 42, 44 is formed as a stem-type element that is positioned in respective valve chambers 46, 48. The valves 42, 44 are biased and reciprocate within the chambers 46, 48 to open and close ports (not shown) in the chambers. Opening and closing the ports serves to feed, isolate and vent compressed gas from pathways to actuate or isolate the tensioning and sealer motors 18, 21. An example of the construction and operation of a pneumatic module is provided in U.S. patent application Ser. No. 10/171,890, filed Jun. 14, 2002, entitled Dual Motor Strapper, which application is commonly assigned herewith, and the disclosure of which is incorporated herein by reference.

Figure 3:
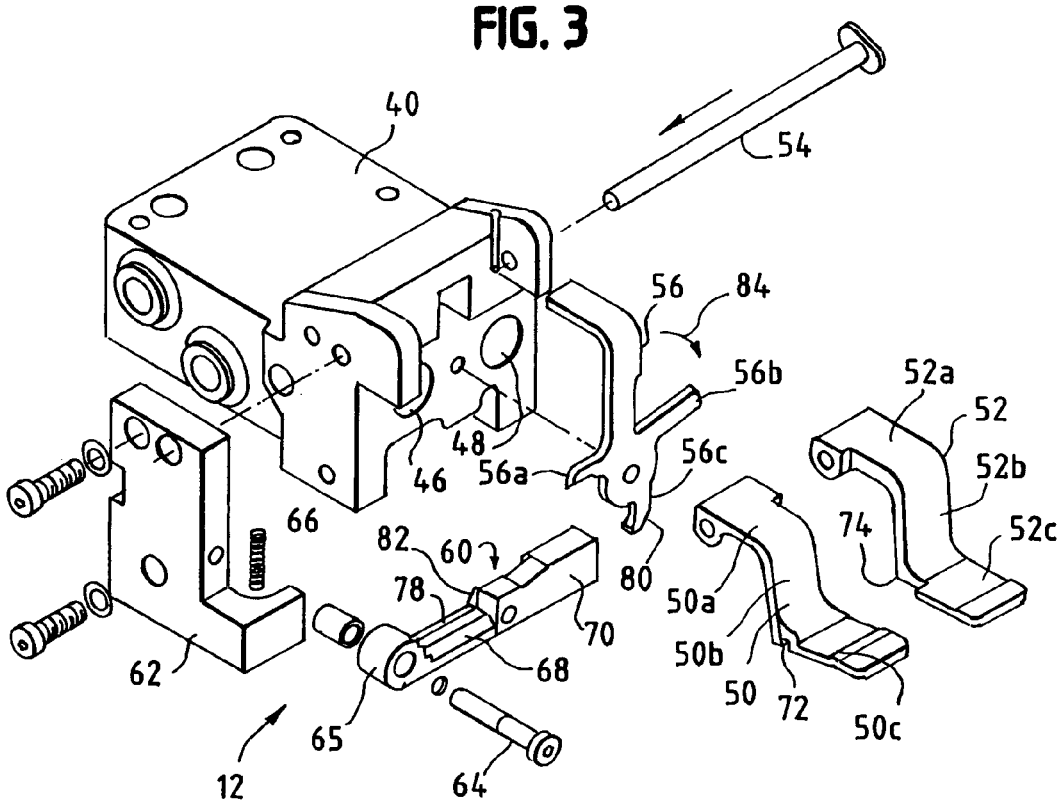
FIG. 3 is an exploded view of the lock-out arm assembly.

As set forth above, the valves 42, 44 reside side-by-side in the housing 40. This is to facilitate operation of the tool 10 as well as the design of the pneumatic module 22. Levers 50, 52 are positioned above and over the valves 42, 44 to provide the leverage required to operate the valves 42, 44. The levers 50, 52 are mounted to the housing 40 so as to pivot about a pin 54 that is mounted to the housing 40 and traverses through the lever 50, 52. As illustrated, the levers 50, 52 are generally Z-shaped with one leg 50*a*, 52*a* pivotally mounted to the housing 40, the interconnecting or body portions 50*b*, 52*b* overlying the valve 42, 44 stems, and the opposite legs 50*c*, 52*c* configured for manual depressing to move or operate the valves 42, 44. A tension valve latch 56 is positioned between the tensioning and sealer levers 50, 52, and includes a pair of lateral arms 56*a*, 56*b*, each of which is positioned above and between the respective valve 42, 44 stems and the levers 50, 52. The illustrated tool 10 includes the sealer lock-out, indicated generally at 12 in FIGS. 1 and 3, in accordance with the present invention.

In typical operation, strap S is wrapped around the load or package P to establish an upper strap layer U and a lower or bottom strap layer L. The lift handle 26 is grasped and squeezed to bring it up toward the handle 24. This opens a space between the foot 16 and gripper 38, into which the bottom strap L is inserted. The lift handle 26 is then released to lock the bottom strap L in place.

Figure 4:
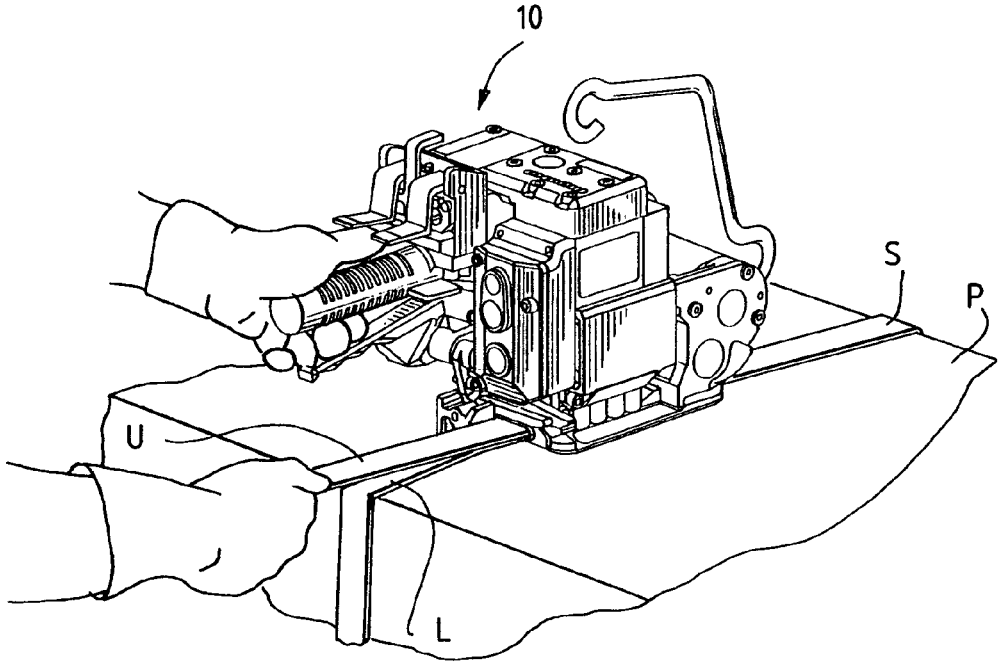
FIG. 4 illustrates the strapper on a load with upper and lower layers of strap material and an operator pulling the slack strap from around the load.

The upper strap U is then inserted into the space over the bottom strap L, on top of the gripper 38 and between the foot 16 and tension wheel 32, and into the strap guide 30. Slack is then pulled from the upper strap U (see FIG. 4).

The tensioning cycle is then initiated by depressing the tensioning lever 50 to a first position which "drops" the tensioning wheel 32 into place on the strap S. Further depressing the lever 50 to a second position starts the tensioning motor 18 to rotate the tensioning wheel 32. In a present strapper 10, the second position is a contact position that does not require that the lever 50 be held in contact with the valve 42. The tensioning wheel 32 rotates (the motor continues to operate) until a desired tension is reached in the strap S at which time the wheel 32 stops and the motor 18 stalls.

Once the tensioning motor 18 stalls, the sealer lever 52 is depressed. This routes the compressed gas (air) to the sealer motor assembly 21 and moves the sealer elements 36 (dies) into contact with the strap S to form the interlocking seal arrangement, and to cut the top strap L beyond the seal to separate the sealed strap portion from the strap supply. The lift handle 26 is then squeezed toward the handle 24 to release the bottom strap L, and the tool 10 is removed from the strap S.

Because the tensioning and sealer levers 50, 52 are close to one another, it has been found that the sealer cycle can be inadvertently initiated before the tensioning cycle is complete. In this situation, the strap S ribbons in the tool, which is a condition in which the strap S is bunched prior to the seal. That is, the slack that would otherwise be pulled from the looped strap is bunched up within the loop. This is, of course, an unacceptable condition.

In order to prevent inadvertent actuation of the sealer cycle prior to completion of the tensioning cycle, the sealer lock-out 12, as introduced above, prevents depressing the sealer lever 52, and functions as a physical interference to inward movement of the lever 52. The lock-out 12 includes a lock-out arm 60 that is operably connected to the valve housing 40 and is positioned between the housing 40 and the lever 52. A present sealer lock-out 12 includes a mounting block 62 that is mounted to a side of the valve housing 40. The arm 60 is pivotally mounted to the block 62 by a pin or bolt 64 to permit the arm 60 to freely pivot. A biasing element 66, such as the illustrated coil spring is disposed to bias the arm 60 upwardly, into an interfering position (that is, to interfere with inward movement or actuation of the sealer valve lever 52).

The arm 60 includes a first ramped portion 68 that cooperates with the tensioning lever 50 and a second blocked portion 70. The ramped portion 68 is disposed on an inner portion of the arm 60; that is, the ramped portion 68 is nearer to the pivot 65, and the block portion 70 is farther along the arm from the pivot axis, as indicated at 65 (near the end of the arm 60). In the home or biased position, the ramp 68 lies behind the heel 72 of the tension lever 50 and the block 70 lies behind the heel 74 of the sealer lever 52. The ramped portion 68 cooperates with the tensioning lever 50 such that when the lever 50 is depressed to the first position (which drops the tensioning wheel 32), the heel 72 does not contact (or minimally contacts) the ramped portion 68 such that the arm 60 remains in the lock-out or interfering position. In this position, the block portion 70 lies behind the sealer lever 52 and interferes with depressing the sealer lever 52 and valve 44 (thus preventing initiation of the sealer cycle).

Only when the tensioning lever 50 is fully depressed does the tensioning lever heel 72 fully engage the ramped portion 68 and urge the arm 60 downward. This removes the interference from the sealer lever 52 and permits the sealer lever 52 to be depressed to initiate the sealer cycle. In addition, lateral arm 56*a* locks into valve 42 stem to maintain the valve 42 in the actuated position.

The arm 60 is configured to cooperate with the tensioning lever 50 to maintain or lock the tensioning lever 50 in the fully depressed position (tension wheel 32 actuation condition) without requiring that the operator maintain pressure on the lever 50. That is, the lever 50 and arm 60 are configured to maintain the valve 42 in the actuated condition once it is depressed. To accomplish this, the arm 60 includes (on the engaging or ramped portion 68), a detent 76 that is configured to cooperate with a lip 78 formed on the lever heel 72. In this manner, the lip 78 locks into the detent 76 to lock the lever 50 when it is fully depressed.

To release the arm 60 from the locked position (that is the position in which the detent 76 and lip 78 are locked to one another), the sealer lever 52 is configured to contact or engage and further urge the arm 60 downwardly when the sealer lever 52 is depressed (or engaged). This unlocks the detent 76 and lip 78 from one another. In that the tensioning valve 42 is biased outwardly (to the non-actuated condition), the lever 50 is urged back up following unlocking the tensioning valve lever 50 from the arm 60. Lever 52 also contacts lateral arm 56*b* to rotate the tension valve latch 56 to unlock arm 56*a* from the valve 42 stem. In this manner, the tensioning valve 42 and lever 50 are reset following completion of the sealing cycle.

In the event that a misfeed or other malfunction occurs, the tensioning cycle can be interrupted without initiating the sealer cycle. The tension valve latch 56, which is mounted to the valve housing 40, includes a lower release arm 56*c* that has a ramped portion 80. The ramped portion 80 cooperates with an intermediate release pin 82 that extends rearwardly from the arm 60, toward the valve housing 40. In the event that it is necessary or desired to interrupt the tensioning cycle, the tension valve latch 56 is rotated clockwise as indicated by the arrow at 84 in FIG. 3, which brings the release arm ramped portion 80 into contact with the release pin 82. This urges the lock-out arm 60 down, which unlocks the tensioning lever lip 78 from the arm detent 76, releases the tensioning valve lever 50 and returns the tensioning valve 42 to the non-actuated position.

It will be appreciated by those skilled in the art that although the present lock-out 12 has been described in connection with a strapping tool 10 for sealing metal strap, the lock-out 12 can also be used in connection with strapping tools for plastic or polymeric strapping material. In addition, although described in connection with a pneumatically actuated or powered tool, the present lock-out 12 can be adapted for use with electrically, as well other actuated or powered tools.

All patents referred to herein, are hereby incorporated herein by reference, whether or not specifically done so within the text of this disclosure.

In the disclosures, the words "a" or "an" are to be taken to include both the singular and the plural. Conversely, any reference to plural items shall, where appropriate, include the singular.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A lock-out assembly for a strapping tool for tensioning a strap around a load, adhering the strap onto itself, the strapping tool having a body, a tensioning wheel and a drive for the tensioning wheel, a sealer and a drive for the sealer and a pneumatic module including a tensioning valve and a sealer valve disposed adjacent one another in the module, each of the valves being reciprocal between an actuated position and a non-actuated position and each operably associated with a lever for reciprocating the respective valve between the actuated and non-actuated positions, the levers being pivotable about a pivot for contacting and reciprocating their respective valves, the levers being pivotable independent of one another, the lock-out comprising:

an arm operably mounted to the pneumatic module, the arm having a first engaging portion for engaging the tensioning valve lever and a second blocking portion for blocking the sealer valve lever, wherein the arm is movable between a first position in which the tensioning valve lever is in the non-actuated position and the arm block portion interferes with movement of the sealer valve lever to prevent moving the sealer valve to the actuated position, and a second position wherein the tensioning valve lever engages the arm engaging portion to move the arm blocking portion from interfering with the sealer valve lever to permit moving the sealer valve lever into contact with the sealer valve to move the sealer valve to the actuated position.

2. The lock-out in accordance with claim 1 including a mounting block for mounting the arm to the module.

3. The lock-out in accordance with claim 1 including a biasing element for biasing the arm to the first position.

4. The lock-out in accordance with claim 3 wherein the biasing element is a spring.

5. The lock-out in accordance with claim 3 wherein the arm engaging portion includes a ramp for engaging the tensioning valve lever, wherein depressing the tensioning valve lever moves the tensioning valve lever onto the ramp, urging the arm against the bias and moving the arm away from the sealer valve lever to permit the sealer valve lever to contact and move the sealer valve.

6. The lock-out in accordance with claim 2 wherein the arm is pivotally mounted to the mounting block at a pivot and wherein the engaging portion is disposed between the pivot and the blocking portion.

7. The lock-out in accordance with claim 6 including a spring mounted between the arm and the mounting block, the spring positioned between the pivot and the engaging portion to urge the arm into the first position.

8. The lock-out in accordance with claim 7 including means for locking the arm in the second position.

9. The lock-out in accordance with claim 8 wherein the means for locking includes a detent formed on the engaging portion cooperating with a lip on the tensioning valve lever, wherein depressing the tensioning arm lever to the actuated position engages the detent with the lip.

10. A lock-out assembly for a strapping tool for tensioning a strap around a load, adhering the strap onto itself, the strapping tool having a body, a tensioning wheel and a drive for the tensioning wheel, a sealer and a drive for the sealer and a pneumatic module including a tensioning valve and a sealer valve disposed adjacent one another in the module, each of the valves being reciprocal between an actuated position and a non-actuated position and each operably associated with a lever for reciprocating the respective valve between the actuated and non-actuated positions, the levers being pivotable about a pivot for contacting and reciprocating their respective valves, the levers being pivotable independent of one another, the lock-out comprising:

a mounting block mounted to the module;

an arm operably mounted to the mounting block, the arm being mounted to the mounting block by a pivot; and a spring disposed between the mounting block and the arm, the spring applying a bias to the arm, the arm having a first ramped portion for engaging the tensioning valve lever and a second blocking portion for blocking the sealer valve lever, wherein the arm is pivotable between a first position in which the tensioning valve lever is in the non-actuated position and the arm block portion interferes with movement of the sealer valve lever to prevent moving the sealer valve to the actuated position, and a second position wherein the tensioning valve lever engages the arm ramped portion urging the arm against the spring bias to move the blocking portion from interfering with the sealer valve lever to permit moving the sealer valve lever into contact with the sealer valve to move the sealer valve to the actuated position.

11. The lock-out in accordance with claim 10 including a detent formed on the arm ramped portion cooperating with a lip on the tensioning valve lever, wherein depressing the tensioning arm lever to the actuated position engages the detent with the lip.

12. A pneumatic module for a strapping tool for tensioning a strap around a load, adhering the strap onto itself, the strapping tool having a body, a tensioning wheel and a drive for the tensioning wheel, a sealer and a drive for the sealer, the pneumatic module comprising:

a housing;

a tensioning valve disposed in the housing;

a sealer valve disposed in the housing adjacent the tensioning valve, each the tensioning valve and the sealer valve being reciprocal between an actuated position and a non-actuated position and each operably associated with a lever for reciprocating the respective valve between the actuated and non-actuated positions, the levers being pivotable about a pivot for contacting and reciprocating their respective valves, the levers being pivotable independent of one another; and a lock-out assembly including an arm operably mounted to the housing, the arm having a first engaging portion for engaging the tensioning valve lever and a second blocking portion for blocking the sealer valve lever, wherein the arm is movable between a first position in which the tensioning valve lever is in the non-actuated position and the arm block portion interferes with movement of the sealer valve lever to prevent moving the sealer valve to the actuated position, and a second position wherein the tensioning valve lever engages the arm engaging portion to move the arm blocking portion from interfering with the sealer valve lever to permit moving the sealer valve lever into contact with the sealer valve to move the sealer valve to the actuated position.

13. The pneumatic module in accordance with claim 12 wherein the lock-out assembly includes a mounting block for mounting the arm to the housing.

14. The pneumatic module in accordance with claim 12 including a biasing element for biasing the arm to the first position.

15. The pneumatic module in accordance with claim 14 wherein the biasing element is a spring.

16. The pneumatic module in accordance with claim 14 wherein the arm engaging portion includes a ramp for engaging the tensioning valve lever, wherein depressing the tensioning valve lever moves the tensioning valve lever onto the ramp, urging the arm against the bias and moving the arm away from the sealer valve lever to permit the sealer valve lever to contact and move the sealer valve.

17. The pneumatic module in accordance with claim 13 wherein the arm is pivotally mounted to the mounting block at a pivot and wherein the engaging portion is disposed between the pivot and the blocking portion.

18. The pneumatic module in accordance with claim 17 including a spring mounted between the arm and the mounting block, the spring positioned between the pivot and the engaging portion to urge the arm into the first position.

19. The pneumatic module in accordance with claim 18 including means for locking the arm in the second position.

20. The pneumatic module in accordance with claim 19 wherein the means for locking includes a detent formed on the engaging portion cooperating with a lip on the tensioning valve lever, wherein depressing the tensioning arm lever to the actuated position engages the detent with the lip.

* * * * *